US010893729B2

(12) United States Patent
Farese

(10) Patent No.: US 10,893,729 B2
(45) Date of Patent: Jan. 19, 2021

(54) WEARABLE CANOPY SHADE

(71) Applicant: Suzanne Farese, Los Angeles, CA (US)

(72) Inventor: Suzanne Farese, Los Angeles, CA (US)

( * ) Notice: Subject to any disclaimer, the term of this patent is extended or adjusted under 35 U.S.C. 154(b) by 0 days.

(21) Appl. No.: 16/663,517

(22) Filed: Oct. 25, 2019

(65) Prior Publication Data

US 2020/0329834 A1 Oct. 22, 2020

Related U.S. Application Data

(60) Provisional application No. 62/884,779, filed on Aug. 9, 2019, provisional application No. 62/835,336, filed on Apr. 17, 2019.

(51) Int. Cl.

| | |
|---|---|
| ***A45B 11/02*** | (2006.01) |
| ***A45F 3/08*** | (2006.01) |
| ***A45B 23/00*** | (2006.01) |
| ***A45B 25/24*** | (2006.01) |

(52) U.S. Cl.

CPC ..... *A45B 11/02* (2013.01); *A45B 25/24* (2013.01); *A45F 3/08* (2013.01); *A45B 2023/0006* (2013.01); *A45B 2023/0093* (2013.01); *A45B 2200/1009* (2013.01)

(58) Field of Classification Search

CPC . A45B 11/00; A45B 11/02; A45B 2023/0006; A45B 2023/0093; A45B 2200/1009; A45B 2200/1054; A45F 4/00; A45F 4/02; A45F 4/04; A45F 2004/023

See application file for complete search history.

(56) References Cited

U.S. PATENT DOCUMENTS

| | | | | |
|---|---|---|---|---|
| 4,170,242 | A * | 10/1979 | Caso | A45B 11/02 135/146 |
| 6,076,539 | A | 6/2000 | Richardson | |
| 6,247,482 | B1 * | 6/2001 | Muis | A45B 11/02 135/16 |
| 6,698,827 | B2 * | 3/2004 | Le Gette | A45F 4/02 297/129 |
| 8,851,343 | B1 | 10/2014 | Evans et al. | |
| 8,944,300 | B1 * | 2/2015 | Kaufman | A45B 11/02 135/16 |
| 9,814,287 | B1 * | 11/2017 | Perez Vazquez | A45B 11/02 |
| 9,907,370 | B2 * | 3/2018 | Huddleston | A45B 11/04 |

(Continued)

*Primary Examiner* — David R Dunn
*Assistant Examiner* — Danielle Jackson
(74) *Attorney, Agent, or Firm* — Argus Intellectual Enterprise; Jordan Sworen; Daniel Enea

(57) ABSTRACT

A wearable canopy shade is provided. The wearable canopy shade includes a canopy secured a frame, wherein the frame includes a bulbous first end and a narrower second end. The frame is movable between an open position and a closed position, wherein the open position, the second end is perpendicular to the first end, such that the second end is configured to rest parallel to a back of a user wearing the shade and the first end rests above a head of the user, providing shade to a user positioned thereunder. The shade includes a pair of shoulder straps that can secure the frame to the user. A cord is securable between the first end of the frame and the pair of shoulder straps in order to prevent the rotation of the first end of the frame relative to the second end when the shade is in use.

18 Claims, 5 Drawing Sheets

(56) References Cited

U.S. PATENT DOCUMENTS

| | | | | |
|---|---|---|---|---|
| 2010/0313922 | A1* | 12/2010 | Raider | A45B 11/02 135/16 |
| 2015/0122862 | A1* | 5/2015 | Guinancio | A45F 3/08 224/637 |
| 2015/0296938 | A1* | 10/2015 | Armina del Valle | A45B 11/02 135/161 |

* cited by examiner

WEARABLE CANOPY SHADE

CROSS REFERENCE TO RELATED APPLICATION

This application claims the benefit of pending U.S. Provisional Application No. 62/835,336 filed on Apr. 17, 2019 and pending U.S. Provisional Application No. 62/884,779 filed on Aug. 9, 2019; the above identified patent applications are herein incorporated by reference in its entirety.

BACKGROUND OF THE INVENTION

The present invention relates to a wearable canopy shade. The present invention further provides a canopy and a frame securable to a user in an open position and foldable for compact storage.

Many people are exposed to the sun during the day when performing outdoor activities, such as yard work, hiking, and the like. Sun damage to a person's skin is caused by the ultraviolet (UV) light produced by the sun and occurs in variety of ways. Exposure to UV light leads to dry skin, sunburn, wrinkles, and more severe issues, such as cancer.

As a solution, some people choose to wear protective gear such as hats or sun visors. Unfortunately, this type of protective gear does not provide the necessary protection to other areas of the body exposed to the harsh UV light, such as one's shoulder, neck, and chest. Further, hats and other wearable shades obstruct the line of sight of the wearer due to the visor being adjacent to eye level. The lack of clear vision can be harmful when performing certain outdoor activities requiring the user to maintain alertness, such as when hiking.

Additionally, while hiking, many people carry backpacks to store fluids, food, camping equipment, and other hiking items. Often times a person may forget to pack protective gear such as a hat or sunscreen. Having a personal shade built-in to the backpack would prevent someone being exposed directly to the sun while donning the wearable canopy shade, despite forgetting to pack protective gear.

In light of the devices disclosed in the known art, it is submitted that the present invention substantially diverges in design elements and methods from the known art and consequently it is clear that there is a need in the art for an improvement for a wearable canopy shade. In this regard the instant invention substantially fulfills these needs.

SUMMARY OF THE INVENTION

In view of the foregoing disadvantages inherent in the known types of wearable canopy shades now present in the known art, the present invention provides a new wearable canopy shade backpack wherein the same can be utilized for securing to the body of a user for providing shade and protection from the sun while outdoors.

It is an objective of the present invention to provide a wearable canopy shade having a canopy secured to an interior perimeter of a frame. The frame includes a bulbous first end and a narrower second end. The frame is movable between an open position and a closed position, wherein the open position the second end is perpendicular to the first end, such that the first end is configured to rest above a head of the user, providing shade to a user positioned thereunder, and the second end is configured to rest parallel to a back of a user wearing the shade.

It is another objective of the present invention to provide a wearable canopy shade having pair of shoulder straps configured to secure the frame to the user. In some embodiments the frame is directly secured to the pair of shoulder straps. In other embodiments, the pair of shoulder straps extend from the canopy. In yet another embodiment, the pair of shoulder straps extend from a backpack, wherein the frame is secured thereto. In some embodiments, a sternum strap extends from the shoulder straps to further secure the wearable canopy shade to the user.

It is yet another objective of the present invention to provide a wearable canopy shade having a cord securable between the first end of the frame and the pair of shoulder straps in order to prevent the rotation of the first end of the frame relative to the second end when the shade is in use. In some embodiments, in the closed position, the frame is folded such that the first end and second end are disposed within the backpack in a stacked configuration for compact storage. In some embodiments, the frame is a monolithic structure. In other embodiments, the frame is configured to twist and fold so as to form a stacked configuration in the closed configuration.

It is another objective of the present invention to provide a wearable canopy shade having a pocket is disposed on a middle section and a solar panel is disposed on the first end to provide energy to an output disposed on the shade. In other embodiments, one or more pouches extend from the shade in order to support a beverage container or personal item, such as a cell phone or wallet.

It is therefore an object of the present invention to provide a new and improved canopy shade backpack that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Reference is made herein to the attached drawings. For the purposes of presenting a brief and clear description of the present invention, the preferred embodiment will be discussed as used for securing to the body of a user to provide shade and protection from the sun while outdoors. The figures are intended for representative purposes only and should not be considered to be limiting in any respect. Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 1B:
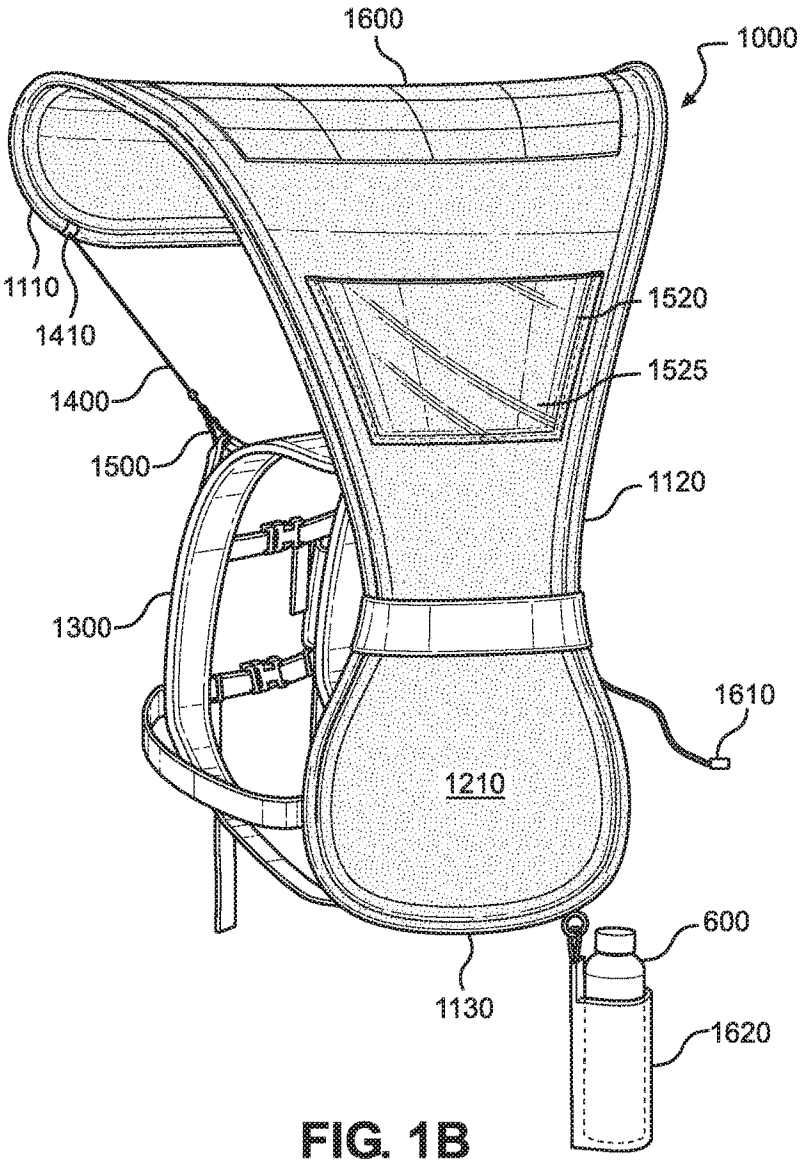
FIG. 1B shows a rear perspective view of a first embodiment of the wearable canopy shade.
Figure 1A:
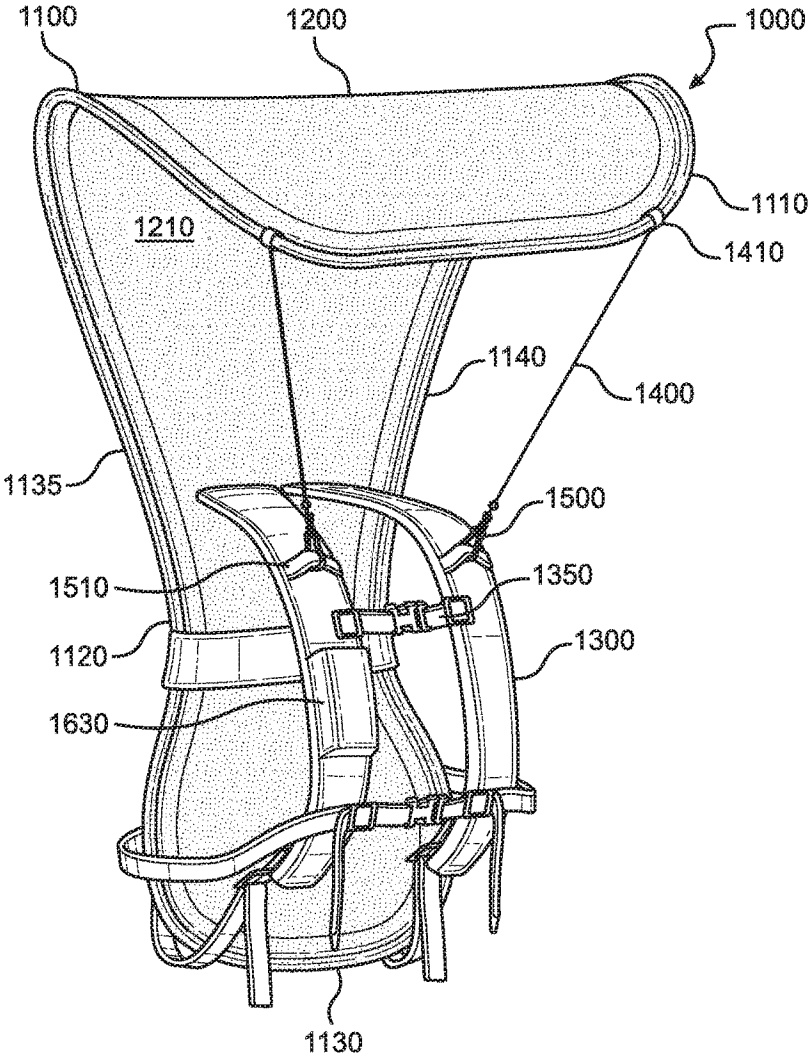
FIG. 1A shows a front perspective view of a first embodiment of the wearable canopy shade.

Referring now to FIGS. 1A and 1B, there is shown a front and rear perspective views of a first embodiment of the wearable canopy shade, respectively. The wearable canopy shade 1000 comprises canopy 1200 secured to a frame 1100. In the illustrated embodiment, the canopy 1200 extends along an entire interior area of the frame 1100, forming a continuous surface 1210. The surface is defined as the area between the bounds of the frame 1100 and within a same plane thereof. In alternate embodiments, the canopy does not extend along the entire interior area of the frame. The wearable canopy shade 1000 is adapted to be worn by a user and protect the user from direct exposure to sun light and weather elements. In some embodiments, the canopy extends beyond the interior perimeter of the frame 1100 so as to provide extended coverage and shade when the wearable canopy shade 1000 is in use. In the illustrated embodiment, the canopy 1200 is composed of durable fabric. However, in alternate embodiments, the canopy 1200 is composed of any suitable material configured to provide shade and reduce UV light passing therethrough. In some embodiments, the material of the canopy 1200 is waterproof, wherein other embodiments the canopy 1200 comprises a waterproof layer. In the illustrated embodiment, the canopy 1200 is composed of a reflective material to prevent a user from being exposed to direct sun light.

Figure 3:
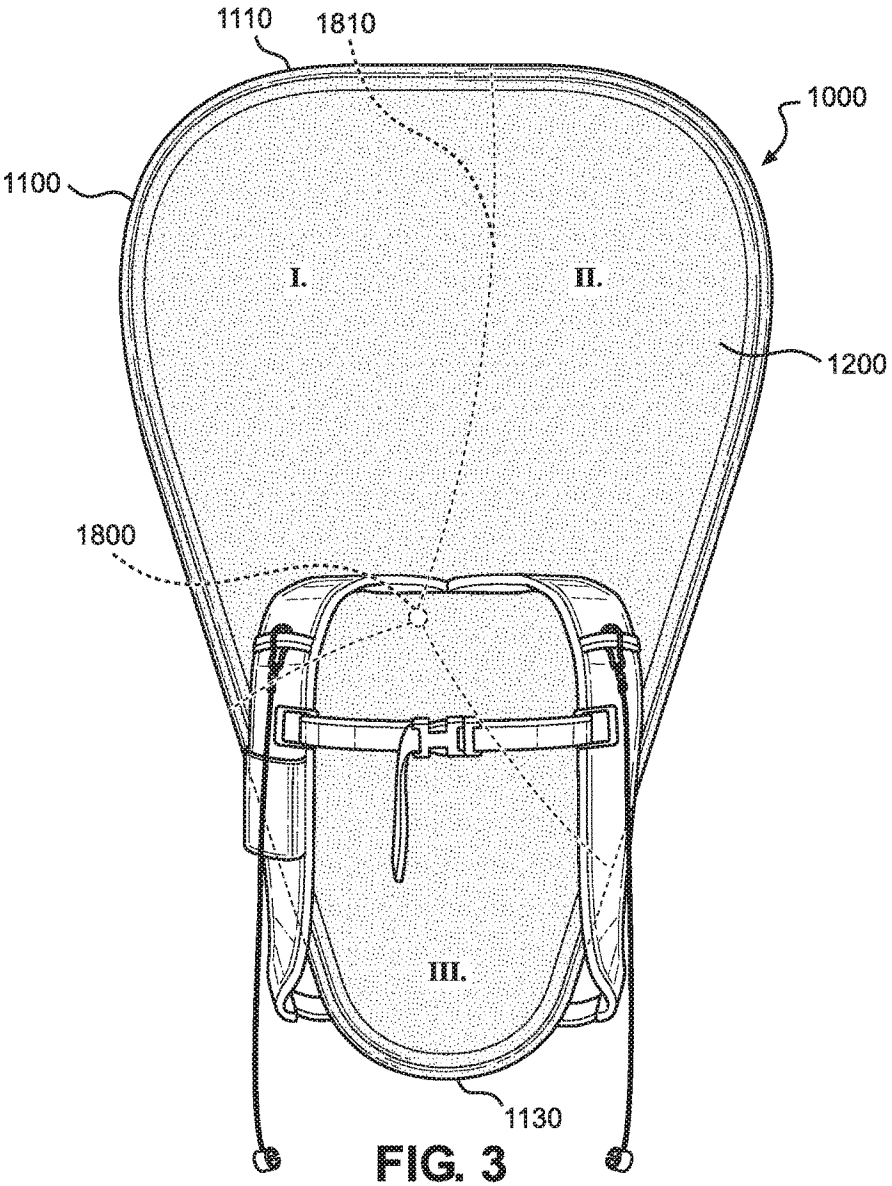
FIG. 3 shows a front view of a third embodiment of the wearable canopy shade.
Figure 5:
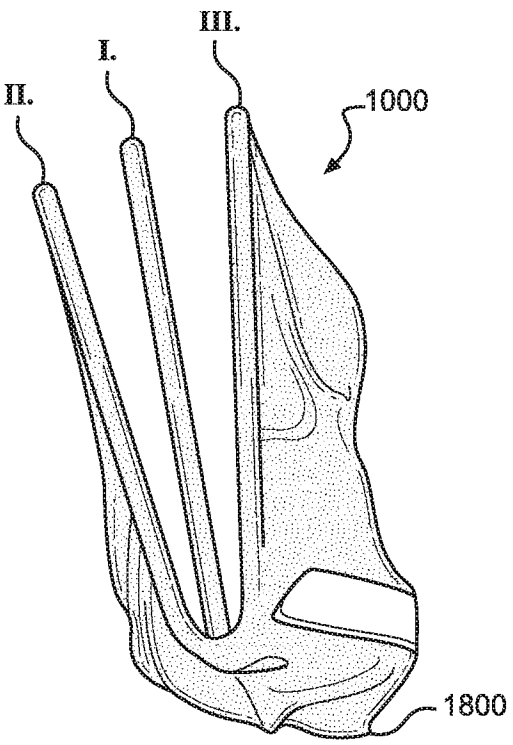
FIG. 5 shows a side perspective view of a third embodiment of the wearable canopy shade transitioning into a folded position.
Figure 4:
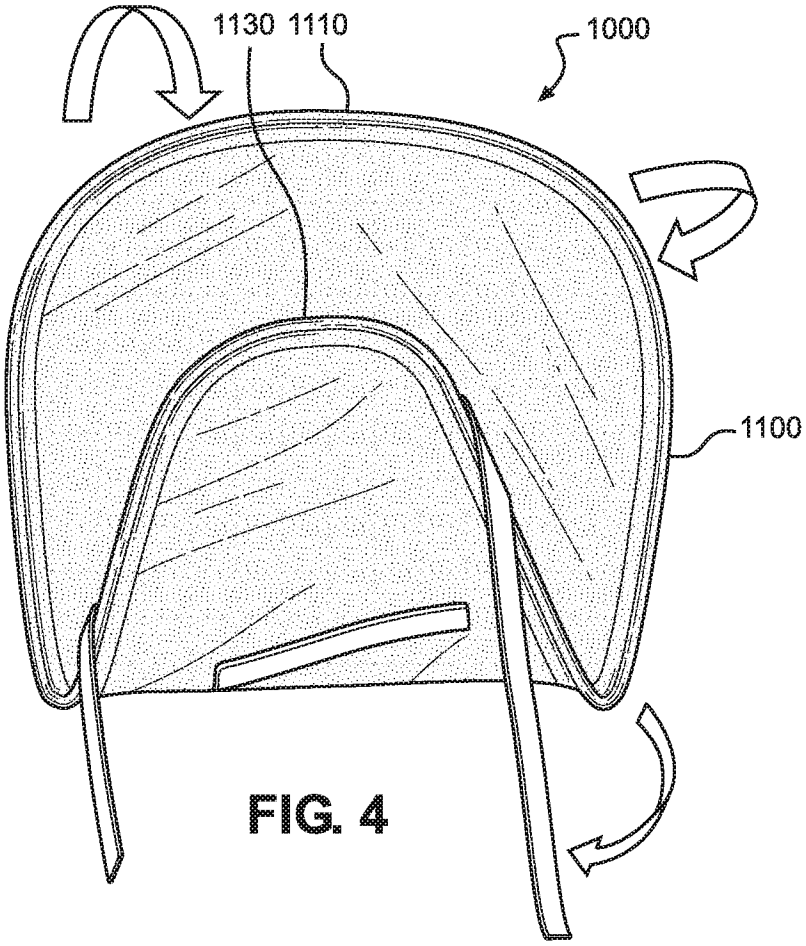
FIG. 4 shows a perspective view of a third embodiment of the wearable canopy shade in a partially folded position.

In the illustrated embodiment, the frame 1100 comprises a bulbous first end 1110, an opposing bulbous second end 1130, and a middle section 1120 tapering inward therebetween. In the illustrated embodiment, an entire lateral width of the first end 1110 is larger than an entire lateral width of the second end 1130. The lateral width is measured and defined as the distance between a first side 1135 of the frame 1100 and an opposing second side 1140. In the illustrated embodiment, the frame 1100 is a monolithic structure. However, in alternate embodiments, the frame 1100 is composed of more than one sections securable to one another. In the illustrated embodiment, the frame 1100 is a flexible memory wire configured to maintain its open configuration. When force is applied to the frame 1100, the frame 1100 can be folded to a closed position and secured with a fastener or other restraint to prevent reopening. When the fastener or other restraint is removed, the frame 1100 is configured to immediately open to the open position. In the illustrated embodiment, the frame 1100 is configured to automatically collapse or fold along a predefined course or fold lines once force is applied thereto (as shown in FIGS. 3-5).

The frame 1100 is movable between an open position and a closed position. In the open position, the second end 1130 is perpendicular to the first end 1110, such that the second end 1130 is configured to rest parallel to a back of a user and the first end 1110 is configured to rest above a head of the user. In the illustrated embodiment, the second end 1130 is configured to rest flat against the back of a user, such that the canopy 1200 is donned directly against and contacting the user. In the open position, the middle section 1120 extends from the shoulders of the user to above the head of the user such that the first end 1110 rests above the user and does not directly contact the user's body.

In the illustrated embodiment, a pair of shoulder straps 1300 extend from the canopy 1200 and configured to secure the wearable canopy shade 1000 to the user. The shoulder straps 1300 extend from the middle section 1120 to the second end 1130. In operation, a user dons the shoulder straps 1300 in a similar manner as shoulder straps of a backpack. In some embodiments, the shoulder straps comprise padding for comfort.

In some embodiments, one or more sternum straps 1350 extend from either an upper or lower portion of the shoulder straps 1300. The sternum straps 1350 are configured to extend perpendicularly from the shoulder straps 1300 and secure around a front side of the user. The configuration of the shoulder straps 1300 and sternum strap 1350 allows the wearable canopy shade 1000 to be secured to the user's body for complete portability and mobility.

In the illustrated embodiment, the wearable canopy shade 1000 comprises one or more cords 1400 securable between the first end 1110 of the frame 1100 and the pair of shoulder straps 1300. The position and structure of the cord 1400 is configured to restrain movement of the first end 1110 of the frame 1100 if there is a strong force, such as wind, from moving the wearable canopy shade 1000. In the illustrated embodiment, the cord extends from a front end of the first end of the frame. In some embodiments, the cord 1400 is slidably secured to frame 1100 via a ring 1410 to allow a user to selectively position the cord relative to the first end 1110 of the frame 1100.

In some embodiments, an end of the cord 1400 includes a clip 1500 adapted to removably secure the cord 1400 to a shoulder strap 1300. In the illustrated embodiment, each shoulder strap 1300 comprises a band 1510 that extends laterally across an exterior thereof. Each band 1510 is configured to receive an end of the cord 1400 via the clip 1500 or other fastener.

In some embodiments, the middle section 1120 comprises a pocket 1520 to allow a user to store objects therein. In other embodiments, the pocket 1520 comprises a transparent front wall 1525 to allow visibility of the interior of the pocket 1520 to display objects stored therein, such as a logo or identification card. In the illustrated embodiment, the pocket 1520 comprises a rectangular shape. However, in alternate embodiments, the pocket comprises any suitable shape. The pocket 1520 is secured to the canopy by any suitable means, such as sewn or adhered thereon.

In some embodiments, a solar panel 1600 is disposed on the canopy 1200 along the first end 1110 of the frame 1100. The solar panel 1600 is configured to supply stored energy to an output 1610 disposed on the wearable canopy shade 1000, wherein the output 1610 is connectable to an electronic device in order to provide power thereto. In alternate embodiments, the solar panel is disposed on any suitable portion of the canopy configured to be exposed to the sun.

In the illustrated embodiment, a first pouch 1620 extends from the second end 1130 of the frame 1100. The first pouch 1620 is configured to receive and support a beverage container 600. In some embodiments, the first pouch 1620 is suspended from the lowermost portion of the second end 1110 of the frame 1100 when in the open position. In some embodiments, a second pouch 1630 extends from the pair of shoulder straps 1300. The second pouch 1630 is configured to support a cell phone or wallet therein.

Figure 2B:
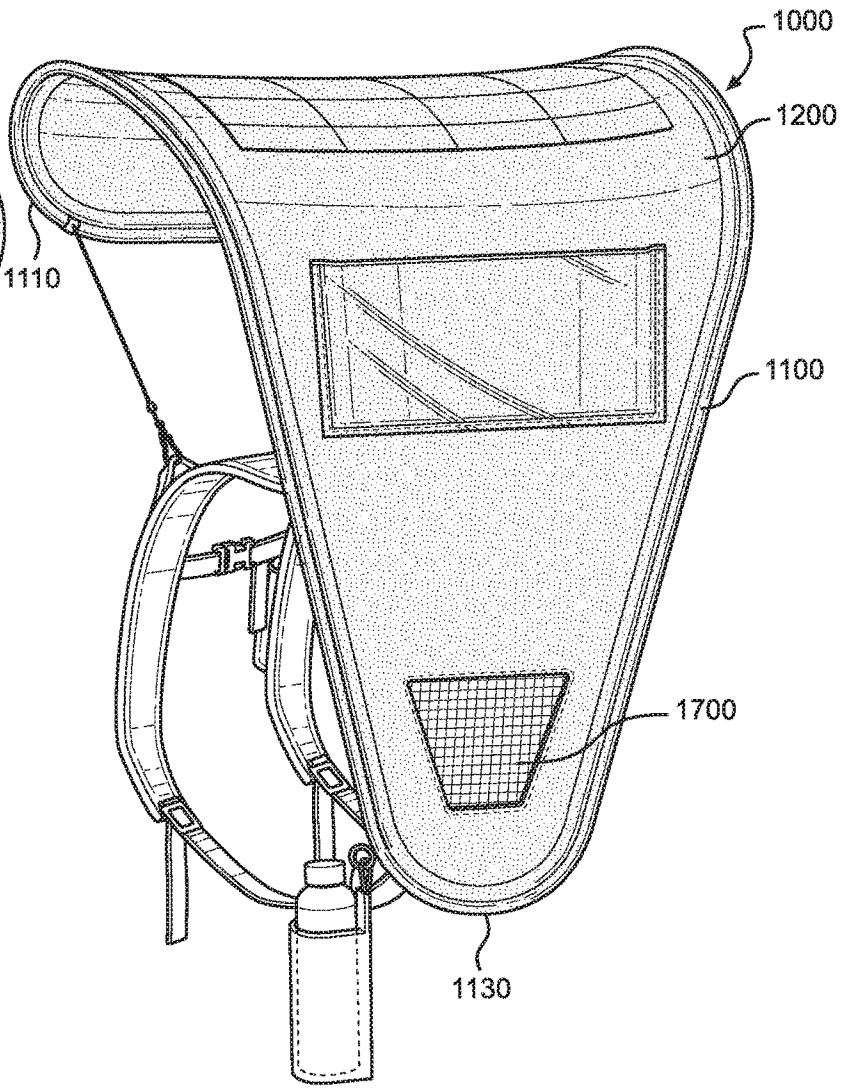
FIG. 2B shows a rear perspective view of a second embodiment of the wearable canopy shade.
Figure 2A:
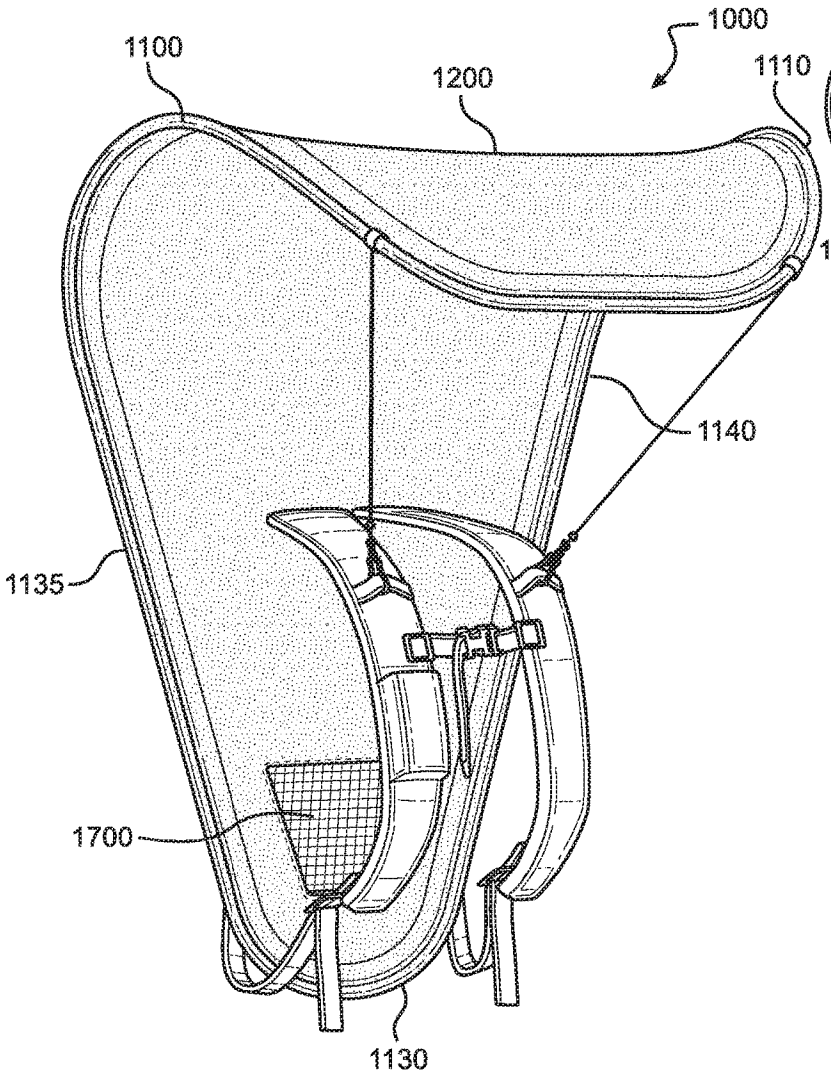
FIG. 2A shows a front perspective view of a second embodiment of the wearable canopy shade.

Referring now to FIGS. 2A and 2B, there is shown front and rear perspective views of a second embodiment of the wearable canopy shade, respectively. In a second illustrated embodiment of the wearable canopy shade 1000, the frame 1100 comprises a continuous linear taper from the first end 1110 to the second end 1130 thereof.

In some embodiments, the canopy 1200 comprises a vent 1700 that allows air to flow from one side of the canopy 1200 to the opposing side therethrough. In the illustrated embodiment, the vent 1700 is composed of mesh material. However, in alternate embodiments, the vent is composed of any suitable material configured to allow air to flow therethrough. In the illustrated embodiment, the vent 1700 is disposed on the second end 1130 to allow air to flow through to the back of the user in order to provide a cooling effect. In the illustrated embodiment, the vent 1700 comprises a trapezoid shape, wherein opposing sides of the vent are parallel to the opposing sides of the frame 1100.

Referring now to FIGS. 3 and 4, there is shown a front view of a third embodiment of the wearable canopy shade and a perspective view of a third embodiment of the wearable canopy shade in a partially folded position, respectively. In the illustrated embodiment, the wearable canopy shade 1000 is foldable about a first, second, and third section I, II, III along fold lines 1810 and a shared point 1800 such that the three sections form a stacked configuration when in a folded position. The shared point 1800 is centrally located on the canopy 1200 when in a planar position. In the folded position, the shared point 1800 is disposed along an outer edge of the wearable canopy shade 1000 (as seen in FIG. 5). The first section I comprises a first corner of the first end 1110, the second section II comprises a second corner of the first end 1110, and the third section comprises the second end 1130.

In the illustrated embodiment, in order to store the wearable canopy shade 1000 in the closed position, the user manipulates the frame 1100 by rotating the second end 1130 towards the first end 1110. As the second end 1130 is rotated towards the first end 1110, the third section III is rotated so as to overlap the first section I. The second section twists and folds under the first and third sections I, III so as to form a stacked configuration.

Referring now to FIG. 5, there is shown a side perspective of the third embodiment of the wearable canopy shade in a folded position. In the folded position, the three sections I, II, III form a stacked configuration. The first section I is sandwiched between the second and third sections II, III. In the closed position, the frame is folded such that the first end, second end, and middle section are in a stacked configuration for flat, compact storage. In some embodiments, the wearable canopy shade comprises a storage pouch configured to receive the frame and canopy in the closed position. In other embodiments, a fastener, such as a clip, secures around the folded wearable canopy shade to prevent the frame from opening.

Figure 7:
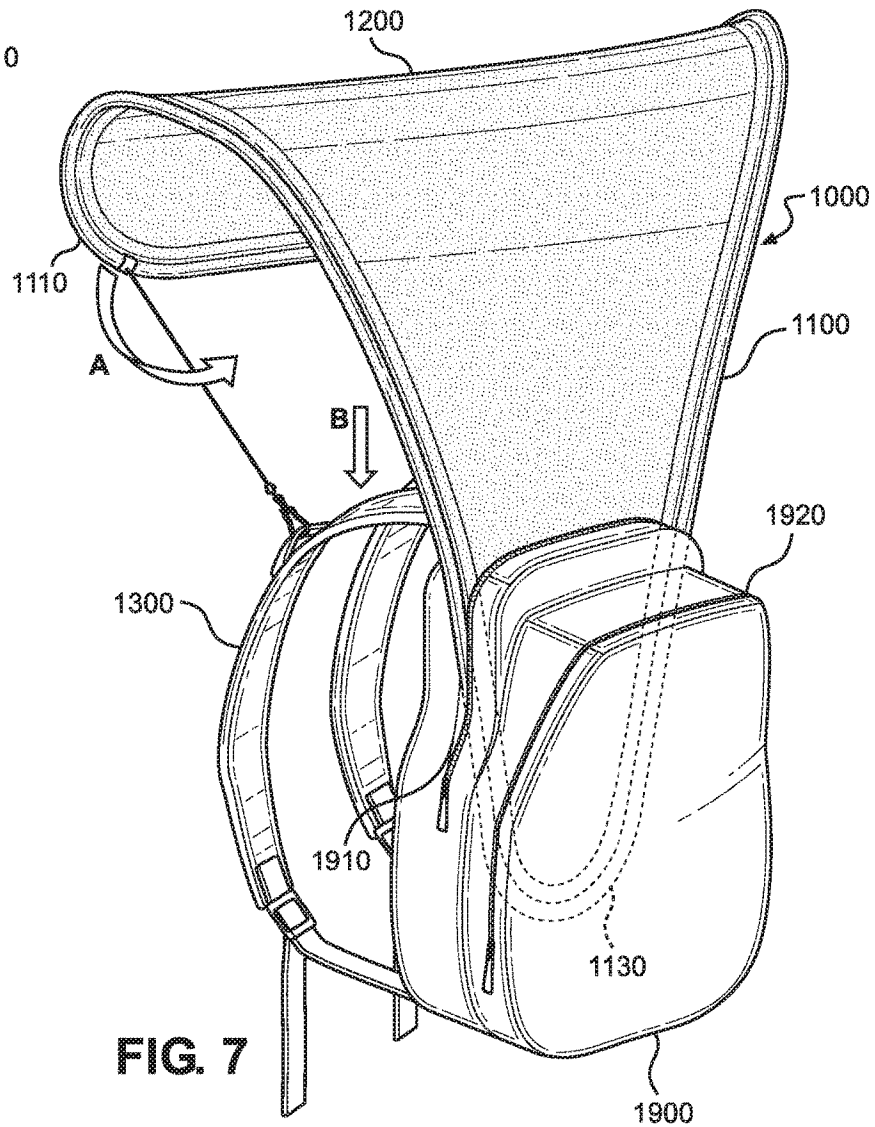
FIG. 7 shows a rear perspective view of a fourth embodiment of the wearable canopy shade.
Figure 6:
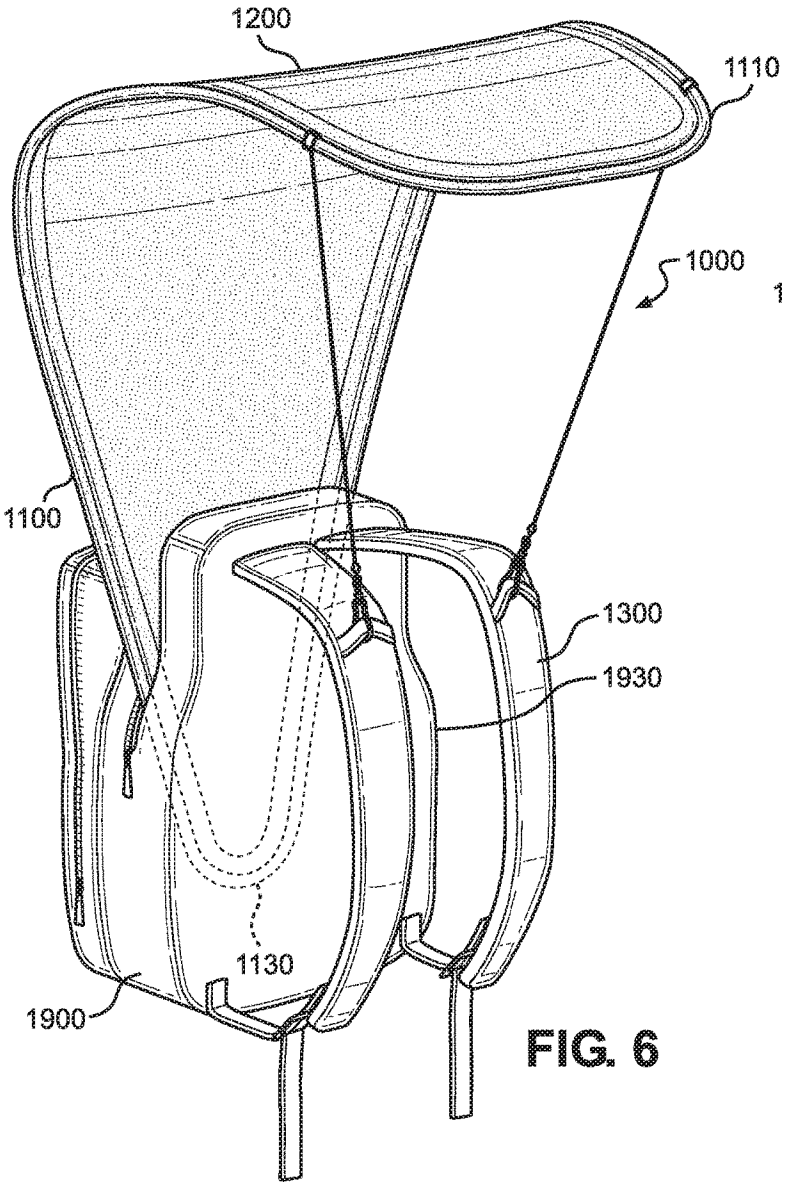
FIG. 6 shows a front perspective view of a fourth embodiment of the wearable canopy shade.

Referring now to FIGS. 6 and 7, there is shown front and rear perspective views of a fourth embodiment of the wearable canopy shade, respectively. In the illustrated embodiment, the wearable canopy shade 1000 includes a backpack 1900, wherein the second end 1130 of the frame 1100 is secured to an interior of the backpack 1900. The frame 1100 is movable between an open position and a closed position. In the open position, the second end 1130 is perpendicular to the first end 1110, such that the second end 1130 is configured to rest within the backpack 1900, while carried by the user, and the first end 1110 is configured to rest above a head of the user.

In the illustrated embodiment, the backpack 1900 comprises at least one main compartment 1910 and at least one secondary compartment 1920, each for storing items. The second end 1130 of the frame 1100 is secured within the main compartment 1910. In some embodiments, the second end 1130 of the frame 1100 is permanently attached to the backpack 1900, while in other embodiments the frame 1100 is removably secured via any suitable fastener such as hook and loop material. The benefit of having the ability to remove the frame 1100 is allowing for more storage space within the backpack 1900 while not using the canopy 1200. In some embodiments, the second end 1130 of the frame 1100 is disposed in an exterior pocket, closest to a rear side 1930 of the backpack 1900, such that the frame 1100 and canopy 1200 can be removed for use without disturbing contents within the main or secondary compartments 1910, 1920. In the illustrated embodiment, the pair of shoulder straps 1300 extend from the rear side 1930 of the backpack 1900 and are configured to secure the wearable canopy shade 1000 to the user.

In order to store the frame 1100 and canopy 1200 of the wearable canopy shade 1000 in the closed position, a user manipulates the frame 1100 by folding the first end 1110 towards the second end 1130 (Direction A) and moved downwards (Direction B) into the main compartment 1910 of the backpack 1900. The first end 1110 is folded parallel to and over the second end 1130 of the frame 1100, forming a first folded position. In some embodiments, fasteners secure the first end to the second end in a stacked configuration, such that the first folded position is the closed configuration. In other embodiments, a pocket within the main compartment receives the first end of the frame in order to restrict further movement thereof.

In alternate embodiments, after forming the first folded position such that the first end overlays the second end, the frame 1100 is twisted approximately 180 degrees about a longitudinal axis, forming a second folded position, and then folded horizontally about the rotation such that the folded sections overlap again, such that the frame 1100 forms the closed position. In the closed position, the frame 1100 is folded such that the first end and second end 1110, 1130 are in a stacked configuration for flat, compact storage.

In operation, the wearable canopy shade is removed from a storage pouch, backpack, or other restraint and immediately opens to the opened position. A user dons the wearable canopy shade similar to a backpack such that the first end 1110 of the frame 1100 floats above the user's head and neck, protecting them from the direct rays of the sun while still allowing the user to move about with arms free and vision unobstructed due to the tapered shape of the middle section.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wearable canopy shade, comprising:

a frame having a first end that tapers to an opposing second end, wherein the frame is movable between an open position and a closed position;

a canopy secured to the frame;

wherein the second end is perpendicular to the first end in the open position, such that the second end is configured to rest parallel to a back of a user and the first end is configured to rest above a head of the user;

a pair of shoulder straps configured to secure the frame to the user;

wherein the frame is folded such that the first end and second end are in a stacked configuration for compact storage in the closed position;

wherein the frame is a monolithic structure.

2. The wearable canopy shade of claim 1, further comprising a transparent pocket disposed on an exterior side of the canopy.

3. The wearable canopy shade of claim 1, further comprising a solar panel disposed on the first end and an output operably connected to the solar panel, wherein the output is connectable to an electronic device.

4. The wearable canopy shade of claim 1, further comprising a pouch extending from the second end of the frame.

5. The wearable canopy shade of claim 4, further comprising a second pouch extending from the pair of shoulder straps.

6. The wearable canopy shade of claim 1, further comprising a sternum strap extending perpendicularly between the pair of shoulder straps.

7. The wearable canopy shade of claim 1, further comprising a cord securable between the first end of the frame and the pair of shoulder straps.

8. The wearable canopy shade of claim 7, further comprising a clip extending from a first end of the cord and a band extending across each shoulder strap, wherein the clip is removably securable to the band to secure the cord to the pair of shoulder straps.

9. The wearable canopy shade of claim 8, wherein a ring extends from a second end of the cord and slidably secures the cord to the first end of the frame.

10. The wearable canopy shade of claim 1, wherein the canopy forms a continuous surface within the frame.

11. The wearable canopy shade of claim 1, wherein the canopy comprises a vent disposed on the second end of the frame.

12. The wearable canopy shade of claim 1, wherein opposing sides of the frame taper inward between the first end and second end of the frame.

13. The wearable canopy shade of claim 1, wherein the second end of the frame is secured to an interior of a backpack.

14. The wearable canopy shade of claim 13, wherein the frame and the canopy form the closed position within the interior of the backpack.

15. A wearable canopy shade, comprising:

a frame having a first end that tapers to an opposing second end, wherein the frame is movable between an open position and a closed position;

a canopy secured to the frame;

wherein the second end is perpendicular to the first end in the open position, such that the second end is configured to rest parallel to a back of a user and the first end is configured to rest above a head of the user;

a pair of shoulder straps configured to secure the frame to the user;

wherein the frame is folded such that the first end and second end are in a stacked configuration for compact storage in the closed position;

a cord securable between the first end of the frame and the pair of shoulder straps;

a clip extending from a first end of the cord and a band extending across each shoulder strap, wherein the clip is removably securable to the band to secure the cord to the pair of shoulder straps;

wherein a ring extends from a second end of the cord and slidably secures the cord to the first end of the frame.

16. The wearable canopy shade of claim 15, wherein the canopy comprises a vent disposed on the second end of the frame.

17. The wearable canopy shade of claim 15, wherein the second end of the frame is secured to an interior of a backpack.

18. The wearable canopy shade of claim 17, wherein the frame and the canopy form the closed position within the interior of the backpack.

* * * * *